US007530296B1

(12) United States Patent
Broadus

(10) Patent No.: US 7,530,296 B1
(45) Date of Patent: May 12, 2009

(54) COMBINATION PLIERS AND SPUDDING TOOL

(76) Inventor: Brad Broadus, P.O. Box 40, Calico Rock, AR (US) 72519

( * ) Notice: Subject to any disclaimer, the term of this patent is extended or adjusted under 35 U.S.C. 154(b) by 0 days.

(21) Appl. No.: 11/808,716

(22) Filed: Jun. 12, 2007

(51) Int. Cl.
*B25B 7/04* (2006.01)
*B25B 7/22* (2006.01)

(52) U.S. Cl. ..... 81/414; 81/411; 81/413; 7/125; 7/127

(58) Field of Classification Search ..... 81/411, 81/413, 414; 7/125, 127
See application file for complete search history.

(56) References Cited

U.S. PATENT DOCUMENTS 854,248 A 5/1907 Smith
1,341,712 A 6/1920 Gell
1,342,856 A 6/1920 McDowell
1,828,142 A 10/1931 Herdman
2,366,312 A 1/1945 Brintnall
3,760,473 A * 9/1973 Studdard ..... 407/29.1
4,375,174 A * 3/1983 Shanley, Jr. ..... 81/165
4,794,824 A * 1/1989 Chapman ..... 81/165
5,267,366 A * 12/1993 Frazer ..... 7/128
5,575,029 A 11/1996 Simpson
6,081,952 A 7/2000 Haxton
6,901,823 B2 6/2005 Ernesti

* cited by examiner

*Primary Examiner*—Joseph J Hail, III
*Assistant Examiner*—Shantese McDonald
(74) *Attorney, Agent, or Firm*—Dowell & Dowell

(57) ABSTRACT

A combination tool that includes opposing jaws and handles that function as conventional pliers and wherein the handles are configured to be abutted with one another to form a spudding tool having a generally circular cross section and wherein at least one stud extending from one of the handles cooperatively seats within at least one hole in the opposing handle when the handles are abutted with one another.

9 Claims, 5 Drawing Sheets

COMBINATION PLIERS AND SPUDDING TOOL

BACKGROUND OF THE INVENTION

1. Field of the Invention

This application is directed to a combination hand tool that may be used as conventional pliers, and preferably, channel lock pliers, as well as for a spudding tool that may be used to engage and align parts, components and other structural elements by hand wherein one or more openings in the structural elements to be aligned are used to manipulated the structural elements with respect to one another.

2. Brief Description of the Related Art

Spudding tools are hand held or manipulated tools that include a pointed shaft that is tapered from a pointed end outwardly to a handle. Such tools are used to facilitate the alignment of one or more parts, plates, or other members that are to be aligned for one reason or another, such that they be ultimately connected or joined or connected. Such tools are commonly used by iron workers, millwrights, metal building fabricators and erectors, machinists, shop mechanics, concrete form assemblers and the like.

Conventional spudding tools are formed as a single "shaft-like" device that is integrally formed of a metal material. The tools have very limited functionality and are specifically designed and configured for use as alignment probes for specific members, objects or structures or to clear holes that must be cleaned or finished in order to permit bolts or other fasteners to be inserted and properly seated therein during a "bolt-up" assembly of parts or components.

Unfortunately, because of their limited functionality for the alignment of two or more separate objects or the finishing or clearing of holes, such tools have been exclusively required as separate members of a workers tool set. Further, because the size of the members, objects or structures to be aligned or finished may vary, workers must often carry a plurality of spudding tools.

Often, those who must use spudding tools must also have tools that are useful to grip and manipulate objects in a manner that is possible using pliers or the like. Therefore, such workers must carry a plurality of separate tools to perform separate hand manipulative functions. Not only does the need for a plurality of separate tools require a greater economic expenditure to be made for the tools used in a specific trade, but the need to carry additional tools for separate unique functions adds to the logistical burdens that are placed on workers to carry the tools on work projects.

In view of the foregoing, there is a need to provide a tool that is unique and multi-functional and not only provides usefulness as a hand held pair or pliers, or the like, but wherein the pliers may also be use in a safe manner as a spudding tool to facilitate the alignment of parts and components as may be necessary on a specific work site or to clear or finished rough openings or holes in work members.

SUMMARY OF THE INVENTION

This application is directed to a combination hand tool that includes a pair of opposing jaws that may be manipulated in the manner of conventional pliers, or the like, and more particularly, to a tool having a pair of hand manipulated handles that are used to control movement and force generated by the opposing jaws of the tool and, wherein, the tool may be used as a spudding tool by interengaging the handles of the tool with one another, when the handles are closed relative to one another, to thereby create a reinforced and pointed rod-like spudding tool.

It is a primary object of the invention to provide a combination tool that may be used as a conventional pair of pliers, such as a pair of channel-lock pliers and wherein, when the jaws of the pliers are closed relative to one another, the handles interlock with one another such that the opposing handles form a rod shaped structure that tapers inwardly toward a forward end thereof such that the handles may be used as a spudding tool.

It is another object of the invention to both reduce tool costs and to enhance the usefulness of a single tool to provide for a plurality of differing work functions.

BRIEF DESCRIPTION OF THE DRAWINGS

A better understanding of the present invention will be had with reference to the accompanying drawings wherein.

DESCRIPTION OF THE PREFERRED EMBODIMENT

Figure 1:
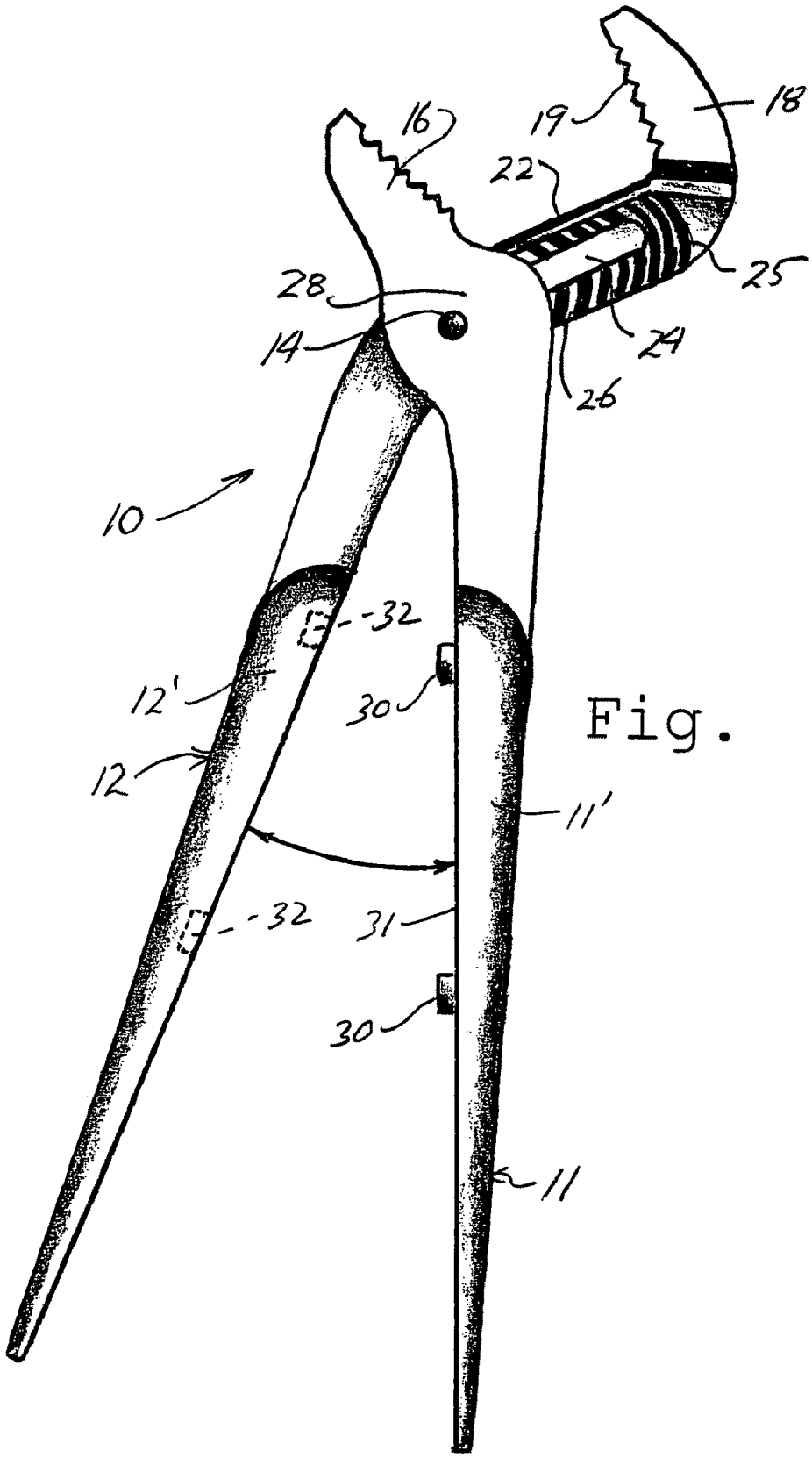
FIG. 1 is a front view of a pair of channel lock pliers that include interlocking studs and recesses formed in the opposing handles of the pliers wherein the jaws and handle being spread apart to a maximum setting as if the tool is being used as a pair of pliers.

With continued reference to the drawings, the combination hand tool of the invention includes a pair of pliers 10, which are shown as channel lock pliers having a pair of handles 11 and 12 that are connected to one another by a pivot pin 14. The handles are integrally formed with opposing jaw members 16 and 18 that are preferably provided with teeth 19 to facilitate gripping an object to be manipulated by the pliers. As the preferred embodiment shown in the drawings is directed to a pair of channel lock type pliers, the jaws and handles are connected by the pivot pin so as to be selectively adjustable relative to one another such that the spacing between the jaws may be varied as required. In this respect, jaw member 18 is connected to handle 12 by way of an integral connector segment 22 that includes an elongated slot 24 in which the pivot pin 14 is guidingly retained such that an actual pivot point between the jaws may be varied as desired.

Figure 4:
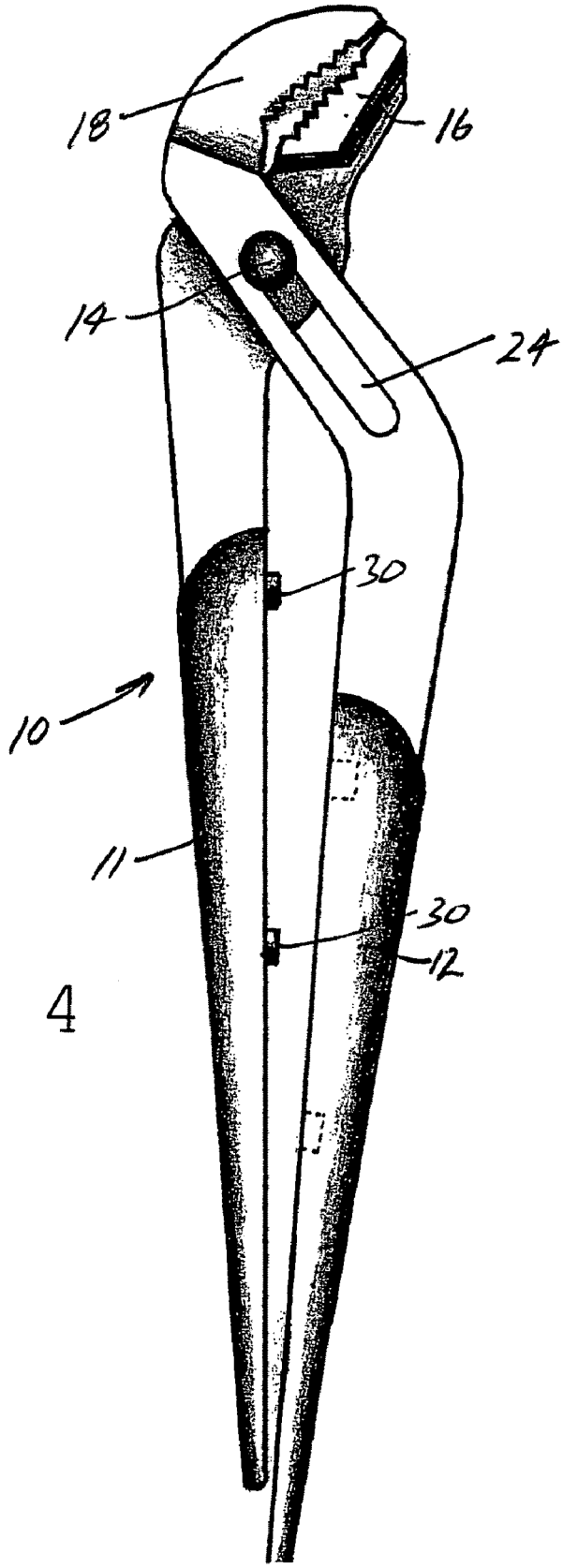
FIG. 4 is a front elevational view similar to FIG. 1 showing the jaws adjusted to a minimum spacing relative to one another.

In order to constrain the arcuate movement of the jaws in a fixed arcuate motion relative to one another regardless of the position of the pivot pin with respect to the slot 24, a series of generally equally spaced and arcuate ridges 25 and grooves 26 are formed in the connector segment that mesh with complementary arcuate ridges and grooves, not shown, that are formed in a connector segment 28 of the opposite handle 11. The meshed engagement of the opposing ridges and grooves ensures an arcuate motion of the opposing jaws relative to one another regardless of the spacing there between. Thus the jaws may be adjusted in increments between a maximum spacing, as shown in FIG. 1, to a minimum spacing, as shown in FIG. 4.

Figure 2:
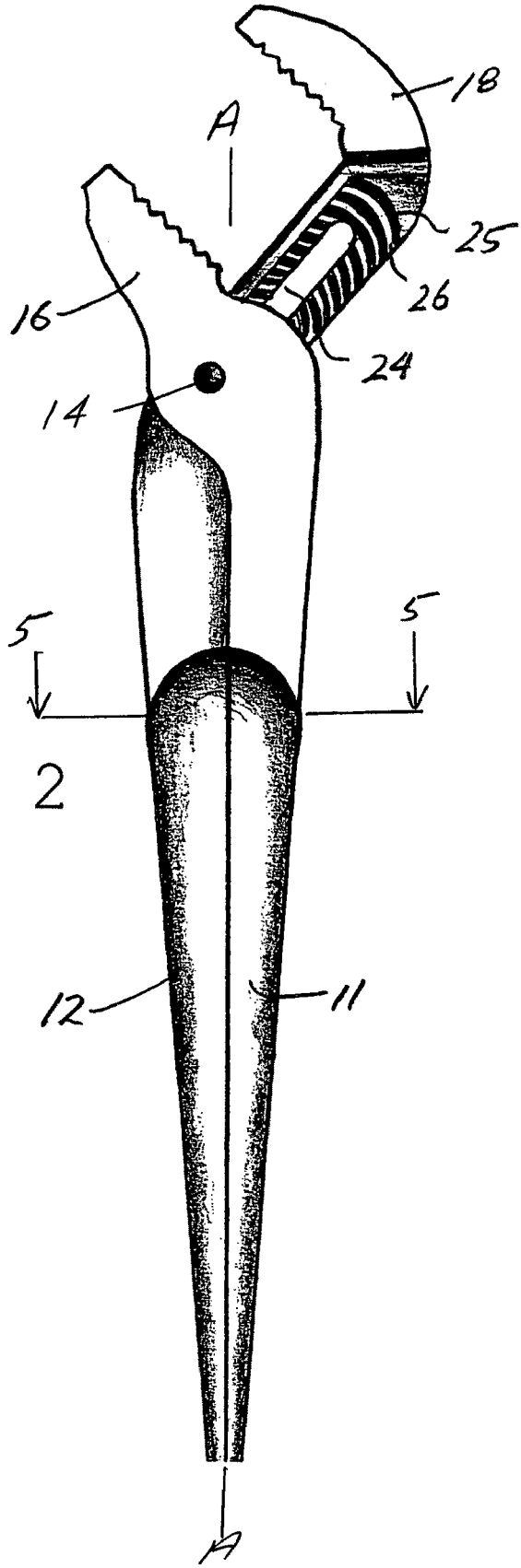
FIG. 2 is a front elevational view of the channel lock pliers of FIG. 1 showing the handles move together to thereby form a penetration shank of a reinforced spud-like alignment tool.
Figure 3:
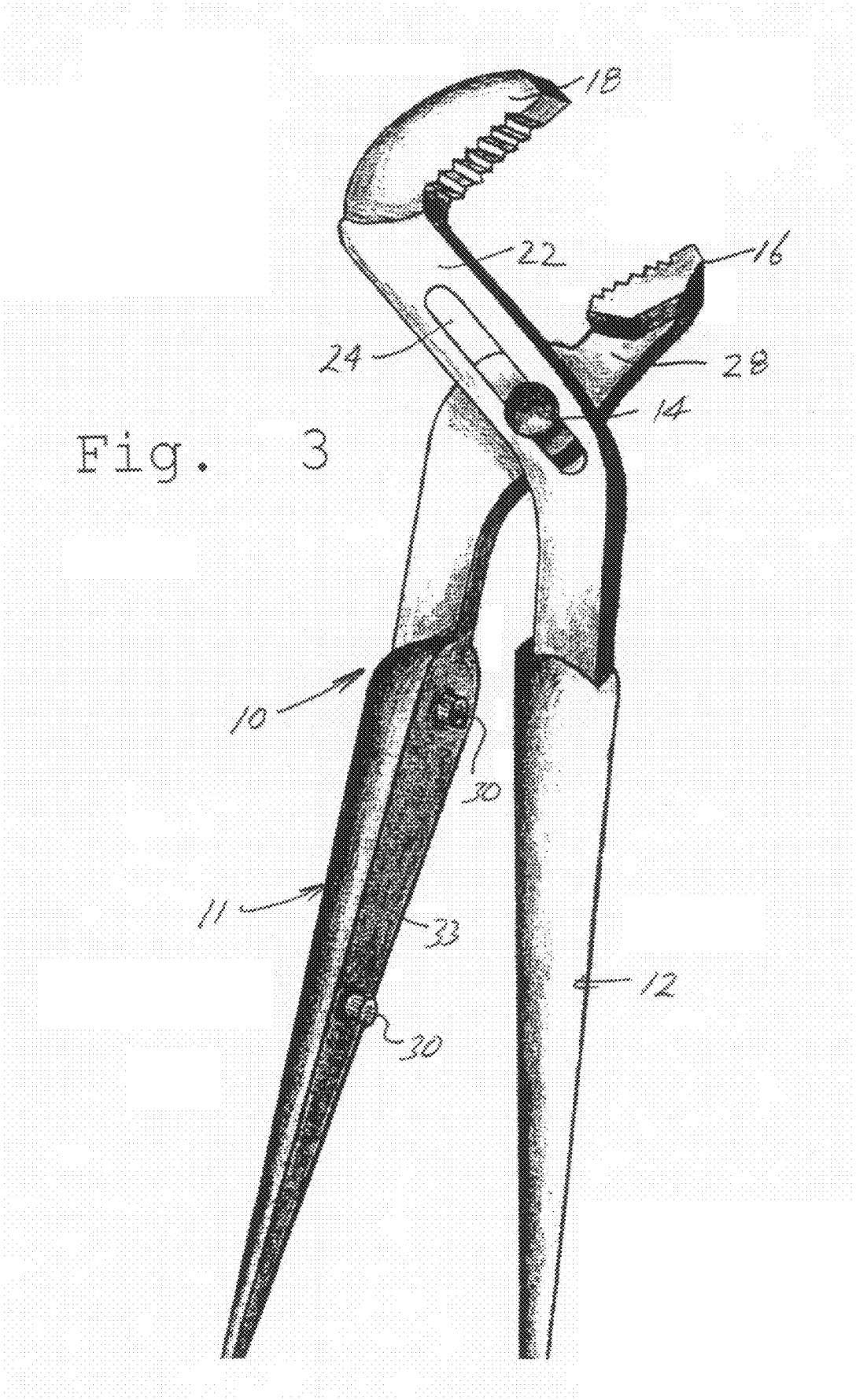
FIG. 3 is a front perspective view of the tool of the present invention showing the handle alignment and reinforcing studs on one of the handles of the tool.
Figure 5:
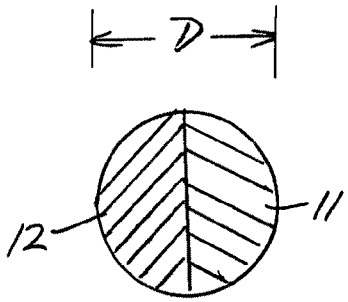
FIG. 5 is a cross sectional view taken along line 5-5 of FIG. 2.
Figure 6:
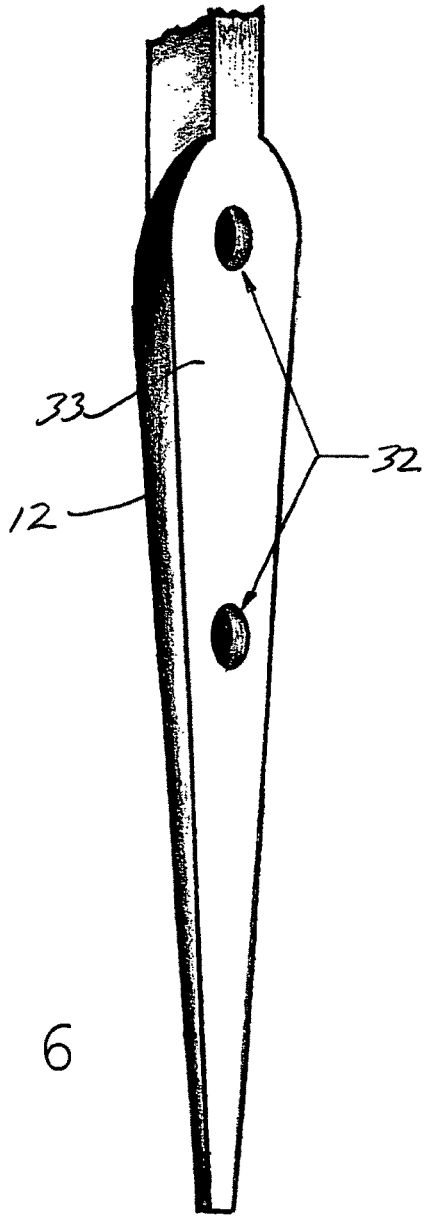
FIG. 6 is a partial view of one of the handles of the tool showing the holes for receipt of the studs of the opposing handle.

As previously described, conventional spudding tools are rod-like tools that taper inwardly from a handle portion to a narrow tip that is used to adjust the position of one part or element with respect to another or to clear holes that must be cleaned or finished in order to permit bolts or other fasteners to be inserted therein during a "bolt-up" assembly of parts or components. Because of their area of use, spudding tools are generally circular in cross section with the diameter of the tools progressively narrowing from the handles to the tips of the tools. As shown in the drawing figures of the present invention, each of the handles 11 and 12 are formed having semicircular cross sections, taken perpendicularly relative to an elongated axis "A" thereof, such that when the handle are aligned and closed relative to one another, as shown in FIG. 2, the combined cross sections of the two handles is circular having a diameter "D", as shown in FIG. 5, that varies along the length of the tool, just the same as a conventional spudding tool. In this respect, the outer surfaces 11' and 12' of the handles are arcuate and semicircular.

To reinforce the handles when they are closed relative to one another to form a spudding tool, handle 11 includes at least one stud 30 that projects outwardly from a flat or planar inner surface 31 of the handle. In the drawings, two studs 30 are shown as being integrally formed with the handle 11 in spaced relationship with one another. It should be noted that the number of studs may be greater than two. The studs are specifically designed and sized to engage within recesses or holes 32 formed in the inner flat or planar surface 33 of the opposing handle 12. Again, the number of holes 32 will vary to match the number of studs. The studs fit within the holes with very little clearance such that the interfitting relationship of the studs and the holes reinforces and prevents any accidental shifting of the handles relative to one another when the combination tool is being used as a spudding tool.

As shown in the drawing figures, only when the jaws of the combination tool are opened to their widest extent such that the pivot pin 14 rests against an end wall of the slot 24, are the studs 30 properly aligned with the holes 32. As shown in FIG. 4, when the jaws are closed relative to one another, the handles 11 and 12 are not properly aligned to permit the studs 30 to enter the holes 32.

In view of the foregoing, the combination tool of the present invention provides usefulness as a conventional pair of pliers, and particularly, channel-lock pliers, and also provides usefulness as a spudding tool when the handles are brought together with the studs of one handle seated within the mating holes in the other. It should be noted that in some embodiments, studs may be provided on both handles that may be selectively seated within recesses or holes provided in the opposite handle.

The foregoing description of the present invention has been presented to illustrate the principles of the invention and not to limit the invention to the particular embodiments illustrated. It is intended that the scope of the invention be defined by all of the embodiments encompassed within the following claims and their equivalents.

I claim:

1. A combination tool comprising a pair of pliers having a pair of opposing jaws that extend from opposing handles, pivot means pivotally connecting the opposing handles to one another, each of said handles having an inner surface that opposes an inner surface of the opposing handle, said inner surfaces being generally planar so as to abut one against the other when the opposing handles are closed relative to one another, said opposing handles taper inwardly along at least a portion of there length toward their free end to thereby form a pointed spudding tool when the opposing handles are closed relative to one another; at least one stud extending outwardly from the inner surface of at least one of the handles, and at least one hole in the opposing handle that is aligned to cooperatively receive the at least one stud extending from the at least one handle and wherein the at least one stud and the hole are cooperatively sized to reinforce and prevent accidental shifting of the opposing handles when the at least one stud is seated within the at least one hole.

2. The combination tool of claim 1 wherein each of the opposing handles tapers inwardly from adjacent the pivot means to free tip end portions thereof.

3. The combination tool of claim 2 wherein each of said opposing handles has semicircular cross sections taken perpendicularly with respect to an elongated axis thereof.

4. The combination tool of claim 3 wherein said pivot means is adjustable along a slot formed in a section intermediate one of the handles and associated jaws of the tool such that the spacing between opposing jaws may be varied from a close proximity relative to one another to a fully spaced relationship relative to one another.

5. The combination tool of claim 4 wherein the at least one stud only aligns to seat with the at least one hole when the pivot means is positioned relative to the slot to fully space the jaws relative to one another.

6. The combination tool of claim 5 including at least two spaced studs extending from the at least one of the handles which are cooperatively seated within at least two spaced holes in the opposing handle.

7. The combination tool of claim 4 including at least two spaced studs extending from the at least one of the handles which are cooperatively seated within at least two spaced holes in the opposing handle.

8. The combination tool of claim 3 including at least two spaced studs extending from the at least one of the handles which are cooperatively seated within at least two spaced holes in the opposing handle.

9. A combination tool comprising a pair of pliers having a pair of opposing jaws that extend from opposing handles, pivot means pivotally connecting the opposing handles to one another, each of said handles having an inner surface that opposes an inner surface of the opposing handle, each of said opposing handles having semicircular cross sections taken perpendicularly with respect to an elongated axis thereof with the inner surfaces thereof being planar and such that when the inner surfaces of the handles are abutted one against the other, the combined cross section of the handles is circular and each of the opposing handles tapers inwardly toward free tip portions thereof such that when the handles are abutted one with the other, the handles form a spudding tool, at least one stud extending outwardly from the inner surface of at least one of the handles, and at least one hole in the opposing handle that is aligned to cooperatively receive the at least one stud extending from the at least one handle and wherein the at least one stud and the hole are cooperatively sized to reinforce and prevent accidental shifting of the opposing handles when the at least one stud is seated within the at least one hole.

* * * * *